US011236508B2

(12) United States Patent
Alkhrdaji

(10) Patent No.: US 11,236,508 B2
(45) Date of Patent: Feb. 1, 2022

(54) FIBER REINFORCED COMPOSITE CORD FOR REPAIR OF CONCRETE END MEMBERS

(71) Applicant: STRUCTURAL TECHNOLOGIES IP, LLC, Columbia, MD (US)

(72) Inventor: Tarek Alkhrdaji, Ellicott City, MD (US)

(73) Assignee: STRUCTURAL TECHNOLOGIES IP, LLC, Columbia, MD (US)

( * ) Notice: Subject to any disclaimer, the term of this patent is extended or adjusted under 35 U.S.C. 154(b) by 0 days.

(21) Appl. No.: 16/708,672

(22) Filed: Dec. 10, 2019

(65) Prior Publication Data

US 2020/0190803 A1 Jun. 18, 2020

Related U.S. Application Data

(60) Provisional application No. 62/778,583, filed on Dec. 12, 2018.

(51) Int. Cl.
*E04C 5/07* (2006.01)
*E04G 23/02* (2006.01)

(52) U.S. Cl.
CPC ..... *E04C 5/073* (2013.01); *E04G 23/0218* (2013.01); *E04G 2023/0251* (2013.01)

(58) Field of Classification Search
CPC ..... E04B 9/006; E04C 5/073; E04G 23/0218; E04G 2023/0251
See application file for complete search history.

(56) References Cited

U.S. PATENT DOCUMENTS 2,921,463 A * 1/1960 Goldfein ..... E04C 5/07 52/223.13
3,298,144 A * 1/1967 Fischer ..... F16B 13/143 52/98
4,793,162 A * 12/1988 Emmons ..... E02B 3/16 156/71

(Continued)

OTHER PUBLICATIONS

Akyuz, Ugurhan and Gokhan Ozdemir. "Mechanical Properties of CFRP Anchorages" 13th World Conference on Earthquake Engineering. 2004.

(Continued)

*Primary Examiner* — James M Ference
(74) *Attorney, Agent, or Firm* — Whiteford, Taylor & Preston, LLP; Gregory M. Stone

(57) ABSTRACT

Disclosed is a fiber-reinforced polymer (FRP) cord system and method that is useful for concrete repair and strengthening applications, including the strengthening of concrete slab edges to increase their resistance to lateral loads from extension elements, such as railings, attached to balconies or façades attached to portions of a building. In certain configurations, fiber-reinforced polymer cords are affixed to a concrete structure along an end surface that includes an extension element, with the fiber-reinforced polymer cords positioned on opposite sides of the extension element. In further configurations, fiber-reinforced polymer cords are affixed to adjacent faces of concrete structures. In particularly preferred configurations, the fiber-reinforced polymer cords are situated within grooves that extend into the faces of the concrete structures that are being reinforced.

8 Claims, 3 Drawing Sheets

(56) References Cited

U.S. PATENT DOCUMENTS 5,049,015 A * 9/1991 Sawaide ..... E04B 1/4164 411/82.1
5,562,377 A * 10/1996 Giannuzzi ..... F16C 17/10 411/82
5,649,398 A * 7/1997 Isley, Jr. ..... E04C 5/07 24/304
5,937,606 A * 8/1999 Meier ..... E04G 23/0218 52/415
6,324,805 B1 * 12/2001 Naniwa ..... E04B 1/2604 52/223.7
6,330,776 B1 * 12/2001 Jinno ..... E04H 9/02 52/649.1
6,393,795 B1 * 5/2002 Irwin ..... F16B 13/141 411/82.1
6,416,256 B1 * 7/2002 Surjan ..... F16B 13/14 405/259.5
6,416,693 B1 * 7/2002 Lockwood ..... E04G 23/0218 156/94
6,418,684 B1 * 7/2002 Morton ..... E04G 23/0218 52/293.2
6,511,727 B1 * 1/2003 Bleibler ..... E04C 5/07 264/285
6,907,697 B2 * 6/2005 Gergely ..... E02D 27/01 52/293.3
7,207,149 B2 * 4/2007 Fyfe ..... E02D 27/42 156/73.2
7,574,840 B1 * 8/2009 Fyfe ..... E02D 27/42 52/223.13
7,716,887 B2 * 5/2010 Fouch ..... E04B 1/26 52/293.3
7,810,293 B2 * 10/2010 Gibbar ..... E04C 2/288 52/309.7
7,930,863 B1 4/2011 Fyfe
7,946,088 B1 * 5/2011 Fyfe ..... E04G 23/0218 52/344
7,980,033 B1 7/2011 Fyfe
8,511,043 B2 8/2013 Fyfe
9,085,898 B2 * 7/2015 Arnold ..... E04C 5/012
9,784,004 B2 * 10/2017 Ervin ..... E04G 23/0218
2001/0047844 A1 * 12/2001 Edwards ..... E04G 23/0218 156/91
2002/0110680 A1 * 8/2002 Bank ..... E04G 23/0218 428/297.4
2002/0170651 A1 * 11/2002 Edwards ..... B29C 70/30 156/94
2004/0016200 A1 * 1/2004 Fyfe ..... E04G 23/0218 52/698
2005/0241260 A1 * 11/2005 Wheatley ..... E04G 23/0218 52/719
2006/0059827 A1 * 3/2006 Wheatley ..... E04G 23/0218 52/506.05
2006/0196146 A1 * 9/2006 Schwegler ..... E04C 5/07 52/741.15
2009/0013625 A1 * 1/2009 Tourneur ..... E02D 27/08 52/223.13
2009/0044476 A1 * 2/2009 Agneloni ..... E04G 23/0218 52/443
2011/0036029 A1 * 2/2011 Tourneur ..... E04G 23/0218 52/309.1
2012/0110940 A1 * 5/2012 Hemphill ..... E04C 5/073 52/514
2012/0255251 A1 * 10/2012 Manos ..... E04G 23/0229 52/309.2
2012/0260601 A1 * 10/2012 Alkhrdaji ..... E04G 23/0292 52/741.3
2013/0239503 A1 * 9/2013 Miller ..... B29C 53/58 52/414
2014/0144095 A1 * 5/2014 Blaszak ..... D03D 13/006 52/514
2014/0245695 A1 * 9/2014 Arnold ..... E04C 3/34 52/831
2015/0075099 A1 * 3/2015 Pantelides ..... E04H 9/025 52/423
2015/0354238 A1 * 12/2015 Abbasi ..... E04G 23/02 52/514.5
2016/0053503 A1 2/2016 Ervin et al.
2016/0138285 A1 * 5/2016 Berset ..... E04G 23/0218 52/514.5
2016/0145882 A1 * 5/2016 Ehsani ..... E04C 3/30 52/741.3
2016/0340556 A1 * 11/2016 Watanabe ..... C09J 7/38
2017/0030096 A1 * 2/2017 Pantelides ..... E04G 23/0218
2018/0187439 A1 * 7/2018 Oliveira De Barros ..... E04G 23/0218
2020/0190803 A1 * 6/2020 Alkhrdaji ..... E04G 23/0218

OTHER PUBLICATIONS

Ceroni, Francesca, et al. "Debonding strength and anchorage devices for reinforced concrete elements strengthened with FRP sheets." Composites Part B: Engineering. vol. 39. 2008. pp. 429-441.
Eshwar, Nagaraj, et al. CFRP Strengthening of Concrete Bridges With Curved Soffits.
Eshwar, Nagaraj, et al. "Effectiveness of CFRP of Strengthening on Curved Soffit RC Beams." 2004.
FRP International. National University of Singapore. Spring 2002.
Jinno, Y., et al. "RC Beams with Slabs Strengthened by CF Sheets and Bundles of CF Strands." FRPRCS-5. 2001. pp. 981-988.
Kim, In Sung. "Use of CFRP to Provide Continuity in Existing Reinforced Concrete Members Subjected to Extreme Loads." 2008.
Kim, S.J. and S.T. Smith "Pull-Out Tests On FRP Anchors" Asia-Pacific Conference on FRP in Structures (APFIS 2007). 2007.
Kobayashi, K., et al. "Advanced wrapping system with CF-anchor—Stress transfer mechanism of CF-anchor—" FRPRCS-5. 2001 .pp. 379-388.
Lam, L. and J.G. Teng. "Strength of RC Cantilever Slabs Bonded With GFRP Strips." vol. 5, No. 4. 2001. pp. 221-227.
Wang, Yung Chih. "Retrofit of Reinforced Concrete Members Using Advanced Composite Materials." 2000.
Masuo, K., et al. Advanced Wrapping System with CF-anchor—Seismic strengthening of RC columns with Wing Walls. FRPRCS-5. 2001. pp. 299-308.
Matsuzaki, Yasuhiro, et al. "Advanced wrapping system with CF-anchor—Shear Strengthening of RC Columns with spandrel wall." FRPRCS-5. 2001. pp. 813-822.
Nagai, H., et al. "Study on Structural Performance of Reinforced Concrete Columns with Waist-High Walls Strengthened by Carbon Fiber Reinforced Plastic Sheets." Fiber Reinforced Polymer Reinforcements. 1999. pp. 255-267.
Oh, H.-S. and J. Sim. "Interface debonding failure in beams strengthened with externally bonded GFRP." Composite Interfaces. vol. 11, No. 1. 2004. pp. 25-42.
Orton, Sarah L., et al. "Design Considerations of Carbon Fiber Anchors." Journal for Composites for Construction. vol. 12. No 6. 2008. pp. 608-616.
Özdemir, Gökhan Mechanical Properties of CFRP Anchorages. Jan. 2005.
Patoary , MD. Kabir Hossain Strengthening of Masonry Walls Against Out-Of-Plane Loads Using FRP Systems. 2004.
Saatcioglu, M., et al. Seismic Performance of Masonry Infill Walls Retrofitted With CFRP Sheets. 2005.
Sanchez, Ismael Basilio. Strengthening of arched masonry structures with composite materials. Jul. 2007.
Seliem, H.M., et al. "Field testing of RC slabs with openings strengthened with CFRP." Fourth International Conference on FRP Composites in Civil Engineering (CICE2008). 2008.
Structural Technologies. Manuel No. IM-6. FRP Sheet Anchorage Using FRP Anchors. Installation Manual. Revised Sep. 23, 2015.
Structural Technologies: Manual No. IM-7. V-Wrap Fiber Cord Anchor System. Installation Manual. Revised: Nov. 1, 2017.
Teng, J.G., et al. "Intermediate crack-induced debonding in RC beams and slabs" Construction and Building Materials. No. 17. 2003. pp. 447-462.

(56) References Cited

OTHER PUBLICATIONS

Teng, J.G., et al. "Retrofitting of Deficient RC Cantilever Slabs Using GFRP Strips." Journal of Composites for Construction. vol. 4. No 2. 2000. pp. 75-84.

Triantafillou, Thanasis, et al. "Externally bonded FRP reinforcement for RC structures." Technical report on the Design and use of externally bonded fibre reinforced polymer reinforcement (FRP EBR) for reinforced concrete structures prepared by a working party of the Task Group 9.3 FRP (Fibre Reinforced Polymer) reinforcement for concrete structures. Jul. 2001.

* cited by examiner

FIBER REINFORCED COMPOSITE CORD FOR REPAIR OF CONCRETE END MEMBERS

CROSS REFERENCE TO RELATED APPLICATIONS

This application is based upon and claims the benefit of U.S. Provisional Application No. 62/778,583 titled "Fiber Reinforced Composite Cord for Repair of Concrete End Members," filed with the United States Patent & Trademark Office on Dec. 12, 2018, the specification of which is incorporated herein by reference in its entirety.

FIELD OF THE INVENTION

This invention relates generally to systems and methods for strengthening and repairing concrete structures, and more particularly to systems and methods for strengthening and repairing concrete structures that are subjected to high lateral loads, such as loads resulting from earthquakes, high winds, hurricanes, explosions, and the like, as may particularly be experienced by end members or edges of concrete slabs.

BACKGROUND

Structures formed of concrete are frequently exposed to high lateral loads. By way of non-limiting example, both newly constructed and longstanding concrete structures can be subjected to high lateral loads caused by earthquakes, high winds, hurricanes, explosions, and other environmental factors. A particular challenge exists with structural concrete elements in the form of slabs, such as might exist on the balcony of a building or at the point of attachment of a façade to a building, where the free ends of those slabs are subjected to, and must be able to withstand, high lateral forces resulting from live loads, explosions, seismic or wind forces. Particularly, such free ends of concrete elements should be configured to minimize cracking that might result from such high lateral forces, which cracking can weaken the connection of the slab and can lead to failure of the structure or structural elements, potentially significantly jeopardizing property and potentially the life of occupants of the structure.

Efforts have been made to address such challenges. For instance, presently known methods for reinforcing concrete structures to withstand high lateral loads typically include using external steel plates and structural steel elements, or using externally applied resin-impregnated fabrics applied to the surface of the concrete. Concrete enlargements with additional reinforcement have also been used for such applications. However, these previously known systems and methods are not always applicable to all situations, and typically create installation challenges as well as aesthetic concerns.

Therefore, there remains a need in the art for systems and methods of concrete strengthening and repair, and particularly the strengthening and repair of ends of concrete members, that avoid the disadvantages of previously known systems and methods and that is inexpensive, durable, easy to install, and effective in reinforcing such structures.

SUMMARY OF THE INVENTION

Disclosed herein is a system and method for strengthening and repairing concrete structures, and particularly the end members of concrete slabs, as are found (by way of non-limiting example) on concrete balconies and points of attachment of façades to a building's concrete exterior. The system and methods disclosed herein may also be used to connect vertical and horizontal concrete members together to improve the load transfer between the elements and increase the lateral load resistance of the system.

In accordance with certain aspects of a particular embodiment, a fiber-reinforced polymer (FRP) cord system is provided that is useful for such concrete repair and strengthening applications, such as (by way of non-limiting example) the strengthening of concrete slab edges to increase their resistance to lateral loads from railings attached to balconies or façades attached to portions of a building. Such FRP cord system is an inexpensive, durable, easy to install, and effective way to reinforce a variety of concrete end members. The FRP cord system described herein may be installed in a small area with minimal disruption to the function of the structure that is undergoing reinforcement or repair, and with minimal or no impact to the dimensions and appearance of the structure. The FRP cord system described herein may optionally be fabricated on site to any dimension and length, and may be formed and installed in various shapes to provide high strength reinforcement and connection systems in a wide variety of customized configurations. Such FRP cord system described herein also increases the stiffness and strength of the element undergoing reinforcement or repair without adding weight that could otherwise adversely affect the performance of the structure, as occurs with the use of external steel elements or concrete enlargement applications.

In accordance with certain aspects of a particular embodiment, a system is provided for reinforcing an end surface of a concrete structure, comprising: a concrete member having a first face, a second face opposite the first face, and a connecting face extending between the first face and the second face; and a first fiber-reinforced polymer cord comprising a bundle of fibers encapsulated in adhesive resin; wherein the first fiber-reinforced polymer cord extends from the first face of the concrete member, across the connecting face of the concrete member, and onto the second face of the concrete member.

In accordance with further aspects of an embodiment, a method is provided for reinforcing an end surface of a concrete structure, comprising the steps of: identifying a region of a concrete member that is to be reinforced, the concrete member having a first face, a second face opposite the first face, and a connecting face extending between the first face and the second face; providing a first fiber-reinforced polymer cord comprising a bundle of fibers encapsulated in adhesive resin; and affixing the first fiber-reinforced polymer cord to the concrete member so that the first fiber-reinforced polymer cord extends from the first face of the concrete member, across the connecting face of the concrete member, and onto the second face of the concrete member.

In accordance with still further aspects of an embodiment, a system is provided for reinforcing a connection of adjacent concrete elements, comprising: a first concrete member having a first face, and a second concrete member having a second face adjacent to and in contact with the first face; and a fiber-reinforced polymer cord comprising a bundle of fibers encapsulated in adhesive resin; wherein the first fiber-reinforced polymer cord extends from the first face of the first concrete member onto the second face of the second concrete member.

In accordance with yet further aspects of an embodiment, a method is provided for reinforcing a connection of adjacent concrete elements, comprising the steps of: identifying a region of adjacent concrete members that is to be reinforced, the concrete members comprising a first concrete member having a first face and a second concrete member having a second face adjacent to and in contact with the first face; providing a fiber-reinforced polymer cord comprising a bundle of fibers encapsulated in adhesive resin; and affixing the first fiber-reinforced polymer cord to the concrete members so that the fiber-reinforced polymer cord extends from the first face of the first concrete member onto the second face of the second concrete member.

BRIEF DESCRIPTION OF THE FIGURES

The novel features of the invention are set forth with particularity in the appended claims. A better understanding of the features and advantages of the present invention will be obtained by reference to the following detailed description that sets forth illustrative embodiments, in which the principles of the invention are utilized. The present invention is illustrated by way of example, and not by way of limitation, in the figures of the accompanying drawings, in which like reference numerals refer to similar elements, and in which:

DETAILED DESCRIPTION OF THE PREFERRED EMBODIMENTS

The invention may be understood by referring to the following description and accompanying drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Descriptions of well-known functions and structures are omitted to enhance clarity and conciseness. The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item.

The use of the terms "first", "second", and the like does not imply any particular order, but they are included to identify individual elements. Moreover, the use of the terms first, second, etc. does not denote any order of importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Although some features may be described with respect to individual exemplary embodiments, aspects need not be limited thereto such that features from one or more exemplary embodiments may be combinable with other features from one or more exemplary embodiments.

In accordance with certain aspects of an embodiment of the invention, FRP composite cords are provided that are preferably formed from bundles of high strength fibers encapsulated in adhesive resin. In a particular configuration, the fiber of such FRP composite cords may be formed of carbon, glass, aramid, basalt, a mixture of the foregoing, or other materials having similar physical characteristics to the foregoing. Likewise, the adhesive resin may be epoxy, vinyl-ester, or other adhesives having similar physical characteristics to the foregoing.

Figure 1:
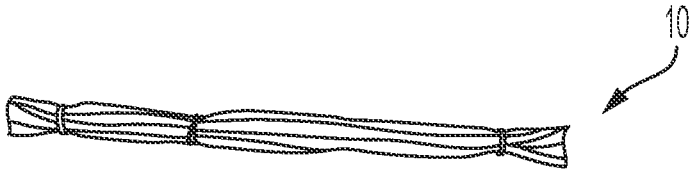
FIG. 1 is a perspective view of FRP composite cords in accordance with certain aspects of an embodiment of the invention.
Figure 2:
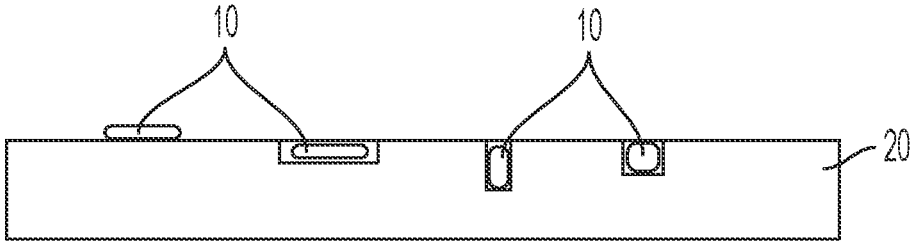
FIG. 2 is a side, cross-sectional view of FRP composite cords reinforcing a structural element in accordance with certain aspects of an embodiment of the invention.
Figure 3:
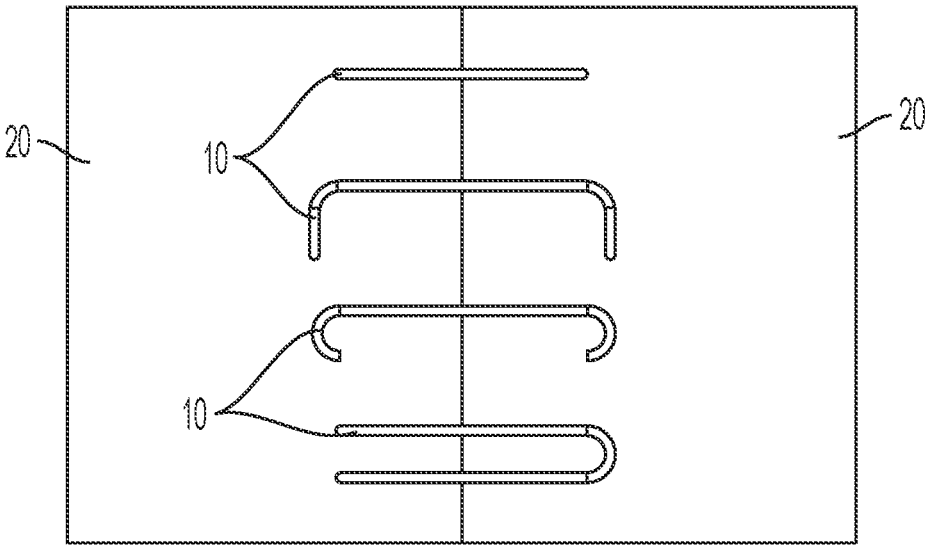
FIG. 3 is a top, plan view of FRP composite cords reinforcing a structural element in accordance with certain aspects of an embodiment of the invention.

In accordance with a particular configuration, FRP composite cords (shown generally at 10), such as that shown in FIG. 1, are formed of unidirectional fibers, such as carbon or glass roving. Optionally, the fibers forming a single FRP composite cord 10 may be formed of one or more types of fibers. The fibers of such FRP composite cords are combined with adhesive resin to create a cured-in-place composite reinforcing system. Such composite reinforcing system consists of FRP composite cords 10 configured as explained herein, which may be recessed into the surfaces of the structural element 20 (e.g., the top, side face, and/or soffit) that is to be strengthened or repaired and forming a straight, curved, U-shape or L-shape configuration, as shown in FIGS. 2 and 3. The particular formation for placement of the FRP composite cord 10 will vary from construction to construction and will depend upon the particular conditions faced by the structure and the current condition of the structure itself. The fiber cords of the FRP composite cord 10 may be made with loose fibers or a fiber bundle, which may then be stitched, wrapped, cross-stitched, or otherwise fashioned to pre-form the desired shape. As shown in FIGS. 2 and 3, the FRP composite cord 10 may be installed on the surface of the concrete structure 20, or may be embedded in grooves that are cut into the surface of the concrete structure 20. FIG. 2 shows installation of the FRP composite cord 10 in a variety of surface applications, including applied atop the surface of the concrete structure 20, and embedded in grooves cut into the surface of the concrete structure 20. FIG. 3 shows possible configurations for placement of the FRP composite cord 10 to connect or to reinforce or strengthen the connection between separate, adjacent concrete structural elements 20. In accordance with certain aspects of an embodiment, the FRP composite cord 10 may be applied in any direction on the concrete structure 20 to achieve various applications.

Figure 4A:
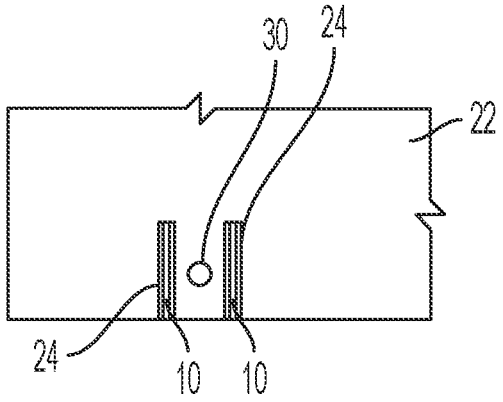
FIG. 4(A) is a top, plan view of FRP composite cords reinforcing a structural element including a post in accordance with certain aspects of an embodiment of the invention.
Figure 4B:
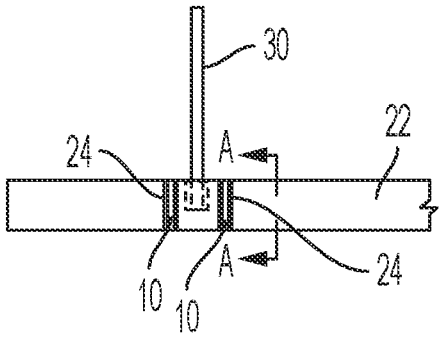
FIG. 4(B) is a side elevation view of the FRP composite cords reinforcing a structural element including a post of FIG. 4(A).
Figure 4C:
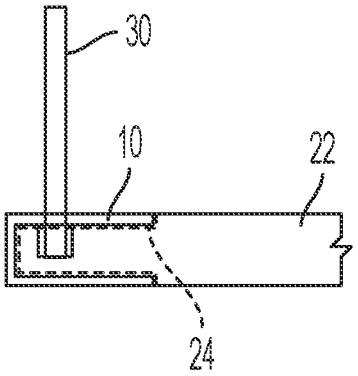
FIG. 4(C) is a side, cross-sectional view of the FRP composite cords reinforcing a structural element including a post of FIG. 4(A).
Figure 5A:
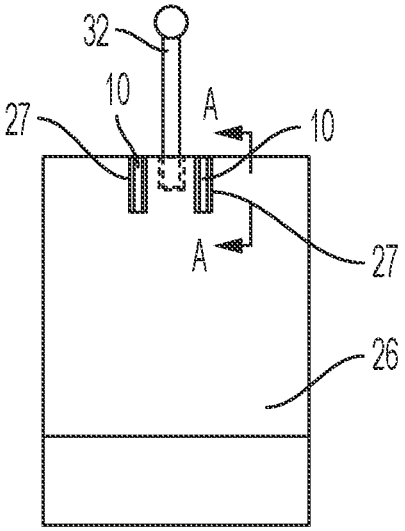
FIG. 5(A) is a side elevation view of FRP composite cords reinforcing a structural element including a railing extending from a parapat in accordance with certain aspects of an embodiment of the invention.
Figure 5B:
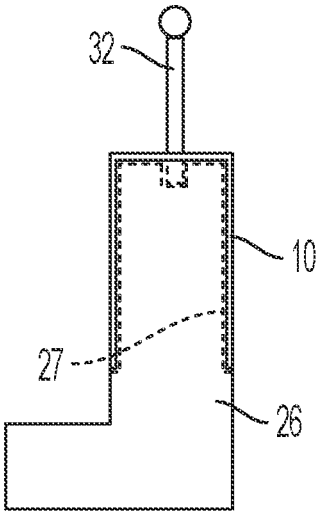
FIG. 5(B) is an end view of the FRP composite cords reinforcing a structural element including a railing extending from a parapat of FIG. 5(A).
Figure 5C:
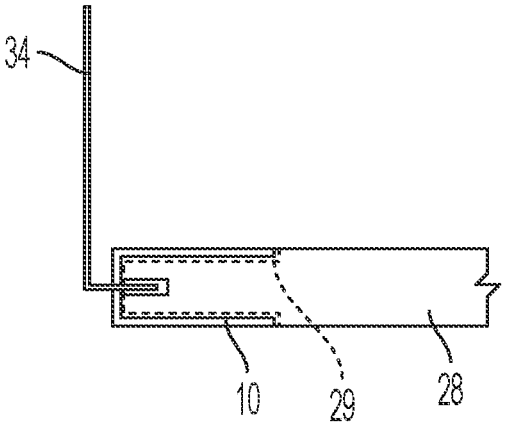
FIG. 5(C) is a side, cross-sectional view of FRP composite cords reinforcing a structural element including a connector element in accordance with certain aspects of an embodiment of the invention.

FIGS. 4 and 5 show various structures on which an FRP composite cord system 100 as discussed above may be used to strengthen and repair both concrete sections of such structures, as well as non-building and non-structural members of such structures, all of which may be subjected to lateral loads due to wind, earthquake, and other environmental factors. More particularly, FIG. 4(*a*) shows a top plan view, FIG. 4(*b*) a side elevation view, and FIG. 4(*c*) a cross-section view of a concrete slab having a post extending upward from the top face of the slab. An FRP composite cord may be provided on each side of the post, each being positioned within a groove cut into the slab along the top surface, the edge surface, and the bottom surface of the slab, and encased in such groove with adhesive resin. Such installation may strengthen the connection of the post to the concrete slab shown in FIG. 4. Likewise, FIG. 5(*a*) shows a side elevation view and FIG. 5(*b*) an end view of a wall section forming a parapet on a building, with a railing or similar structure extending upward from the top face of the wall. Here, an FRP composite cord may be provided on each side of the railing, each being positioned within a groove cut into the concrete wall along the interior surface, top surface, and exterior surface of the concrete wall, and encased in such groove with adhesive resin. Such installation may strengthen the connection of the railing to the top of the concrete wall shown in FIGS. 5(*a*) and 5(*b*). Still further, FIG. 5(*c*) shows a side, cross-sectional view of a concrete slab having a connector element for attaching a façade to the concrete slab, which connector element extends outward from the edge surface of the slab. Here again, an FRP composite cord may be provided on each side of the connector element, each being positioned within a groove cut into the slab along the top surface, the edge surface, and the bottom surface of the slab, and encased in such groove with adhesive resin.

As shown in the foregoing installations, a FRP composite cord 10 configured as described herein may thus be useful in strengthening the connection between a first concrete structure and an additional element, where those building components may be subjected to high lateral loads caused by wind, earthquakes, and the like, including by way of non-limiting example: (i) handrail connections to concrete walls and slabs such as balconies, parapet walls, roof edges, slab ends, and the like; (ii) slab edges for façade connections; and (iii) connecting adjacent concrete elements to one another.

In accordance with further aspects of an embodiment, an FRP composite cord configured as described herein may be used to strengthen or repair a concrete member in accordance with the following processes. First, in the case where it is desired to install an FRP composite cord configured as described herein by embedding the same in a groove in the concrete structure, one or more grooves are first cut in the applicable faces of the concrete element. After such grooves are cut, the surfaces of the grooves are cleaned. Next, compressed air is used to blow dust and debris out of the grooves that have been cut into the concrete element. Next, preferably one coat of adhesive resin is applied to the inside faces of the newly formed grooves. Next, the FRP composite cords configured as described herein are saturated with adhesive resin. The FRP cords may be saturated on-site to create the composite elements, or may be prefabricated off-site. Such resin-saturated FRP composite cords are then installed into the grooves that have been cut into the surface of the concrete member. Finally, additional adhesive resin may optionally be applied, if needed, to fill the grooves and to create an edge that is co-planar with the faces of the concrete structure, and excess resin is removed to provide a clean, flush outer surface.

Likewise, in the case where it is desired to install an FRP composite cord configured as described herein by applying the same to the surface of the concrete structure, the location for chord installation is first identified on the surface of the concrete element that is to be strengthened or repaired. Next, the surface of such concrete element is cleaned and roughened using mechanical means well known to those of ordinary skill in the art. Next, preferably one coat of adhesive resin is applied to the surface of the concrete member along the length of the intended location of the FRP composite cord. Next, the FRP composite cord is saturated with adhesive resin, and the resin-saturated FRP composite cord is applied along the identified location on the surface of the concrete element. Next, the FRP composite cord is manually worked and manipulated to achieve the desired width and thickness. Finally, additional FRP composite cords may optionally be installed on top of the first FRP composite cord until the final desired thickness has been achieved.

Systems and methods using a FRP composite cord configured as described herein may provide one or more of the following benefits. First, such systems and methods may be used to reinforce the edges of slender concrete or masonry elements, such as slabs, piers, and walls. Such systems and methods may also be used to connect vertical and horizontal concrete members together to improve the load transfer between the elements and increase the lateral load resistance of the system. Further, such systems and methods may be used to reinforce corners and edges of concrete structures to aid their resistance to fatigue due to repetitive small loads created by people grasping handrails on stairs, parapet walls, handrails at stadiums, and the like. Still further, such systems and methods may be used to increase the stiffness and strength of concrete structures without a significant increase in weight and volume of that concrete structure. Likewise, such systems and methods may offer easier and faster installation in comparison to enlargement and strengthening processes using steel plates and structure shapes. Even further, because a FRP composite cord configured as described herein is made of a bundle of flexible fibers, it can be placed in any shape and can be spread on the surface of the concrete structure, placed in a wide, shallow groove on the surface of the member, or in a narrow, deep groove in the surface of the structure, thus allowing its adaptability to a variety of circumstances. Still further, such FRP composite cord systems and methods may be implemented without the use of heavy machinery or equipment, and their installation may be performed with a minimal number of workers. Even further, such FRP composite cord systems and methods may minimize the disruption of the function and/or operation of an existing and occupied building due to the ease of the reinforcing process that they enable. Finally, such FRP composite cord systems and methods may offer excellent chemical and corrosion resistance in the extremely alkaline and acidic environments that are typically experienced by such concrete structures.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A system for reinforcing an end surface of a concrete structure, comprising:

a concrete member having a first face, a second face opposite said first face, and a connecting face extending between said first face and said second face;

an extension element at least partially embedded in and extending outward from at least one of said first face, said connecting face, and said second face;

a first fiber-reinforced polymer cord comprising a bundle of fibers encapsulated in adhesive resin and positioned on said concrete member on a first side of said extension element, wherein said first fiber-reinforced polymer cord extends from a first end of said first fiber-reinforced polymer cord along said first face of said concrete member, across said connecting face of said concrete member, and along said second face of said concrete member to a second end of said first fiber-reinforced polymer cord, wherein said first fiber-reinforced polymer cord extends past said extension element between said first end and said second end of said first fiber-reinforced polymer cord; and a second fiber-reinforced polymer cord comprising a bundle of fibers encapsulated in adhesive resin and positioned on said concrete member on a second side of said extension element opposite said first side, wherein said second fiber-reinforced polymer cord extends from a first end of said second fiber-reinforced polymer cord along said first face of said concrete member, across said connecting face of said concrete member, and along said second face of said concrete member to a second end of said second fiber-reinforced polymer cord, wherein said second fiber-reinforced polymer cord extends past said extension element between said first end and said second end of said second fiber-reinforced polymer cord.

2. The system of claim 1, wherein said fiber-reinforced polymer cord is applied to a planar outer surface of each of said first face, said connecting face, and said second face.

3. The system of claim 1, wherein said fiber-reinforced polymer cord is positioned within a continuous groove extending into said first face, said connecting face, and said second face.

4. The system of claim 3, further comprising adhesive resin within said groove surrounding said fiber-reinforced polymer cord and creating an edge that is co-planar with each of said first face, said connecting face, and said second face.

5. A method for reinforcing an end surface of a concrete structure, comprising:

identifying a region of a concrete member that is to be reinforced, said concrete member having a first face, a second face opposite said first face, and a connecting face extending between said first face and said second face, and an extension element at least partially embedded in and extending outward from at least one of said first face, said connecting face, and said second face;

providing a first fiber-reinforced polymer cord comprising a bundle of fibers encapsulated in adhesive resin;

affixing said first fiber-reinforced polymer cord to said concrete member so that said first fiber-reinforced polymer cord is positioned on said concrete member on a first side of said extension element and extends from a first end of said first fiber-reinforced polymer cord along said first face of said concrete member, across said connecting face of said concrete member, and along said second face of said concrete member to a second end of said first fiber-reinforced polymer cord, and so that said first fiber-reinforced polymer cord extends past said extension element between said first end and said second end of said first fiber-reinforced polymer cord;

providing a second fiber-reinforced polymer cord comprising a bundle of fibers encapsulated in adhesive resin; and affixing said second fiber-reinforced polymer cord to said concrete member so that said second fiber-reinforced polymer cord is positioned on said concrete member on a second side of said extension element opposite said first side and extends from a first end of said second fiber-reinforced polymer cord along said first face of said concrete member, across said connecting face of said concrete member, and along said second face of said concrete member to a second end of said second fiber-reinforced polymer cord, and so that said second fiber-reinforced polymer cord extends past said extension element between said first end and said second end of said second fiber-reinforced polymer cord.

6. The method of claim 5, wherein said step of affixing said first fiber-reinforced polymer cord further comprises applying said first fiber-reinforced polymer cord to a planar outer surface of each of said first face, said connecting face, and said second face.

7. The method of claim 5, further comprising the steps of:

forming a continuous groove extending into said first face, said connecting face, and said second face;

wherein said step of affixing said first fiber-reinforced polymer cord further comprises positioning said fiber-reinforced polymer cord within said continuous groove.

8. The method of claim 7, further comprising the step of applying adhesive resin within said groove and surrounding said fiber-reinforced polymer cord to form an edge that is co-planar with each of said first face, said connecting face, and said second face.

* * * * *